US008845070B2

(12) United States Patent
Yamamoto

(10) Patent No.: US 8,845,070 B2
(45) Date of Patent: Sep. 30, 2014

(54) INK-JET PRINT HEAD, INK-JET PRINTER USING THE SAME AND METHOD FOR MANUFACTURING INK-JET PRINT HEAD

(75) Inventor: Keizaburo Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 184 days.

(21) Appl. No.: 13/037,047

(22) Filed: Feb. 28, 2011

(65) Prior Publication Data

US 2012/0044301 A1 Feb. 23, 2012

(30) Foreign Application Priority Data

Aug. 19, 2010 (JP) ..... 2010-184202

(51) Int. Cl.
*B41J 2/015* (2006.01)
*B41J 2/14* (2006.01)

(52) U.S. Cl.
CPC ..... *B41J 2/14209* (2013.01); *B41J 2202/12* (2013.01); *B41J 2002/14362* (2013.01); *B41J 2002/14491* (2013.01)
USPC ..... 347/20

(58) Field of Classification Search
None
See application file for complete search history.

(56) References Cited

U.S. PATENT DOCUMENTS

2003/0090549 A1* 5/2003 Beurer et al. ..... 347/68
2009/0213182 A1* 8/2009 Yamanaka ..... 347/50

FOREIGN PATENT DOCUMENTS

JP 2002-533247 10/2002
JP 2006159507 6/2006
JP 2009-018540 1/2009
JP 2009-178959 8/2009
WO WO-2007/113554 A2 10/2007

OTHER PUBLICATIONS

Japanese Office Action mailed Aug. 20, 2013 in corresponding Japanese Patent Application No. 2010-184202 (with English translation).

* cited by examiner

*Primary Examiner* — Matthew Luu
*Assistant Examiner* — Erica Lin
(74) *Attorney, Agent, or Firm* — Patterson & Sheridan LLP

(57) ABSTRACT

According to one embodiment, an ink-jet print head comprises a support member including a flat portion with an ink supply aperture and an ink discharge aperture formed therein so as to circulate and supply ink, the flat portion including a recess, a base plate fitted in the recess of the support member, a nozzle plate laid over the base plate at a predetermined distance from the base plate and including a plurality of nozzles formed therein in a fixed direction, and an actuator disposed between the base plate and the nozzle plate and including a pressure chamber and a piezoelectric member, the pressure chamber being provided for each corresponding nozzle, and the piezoelectric member being provided to form a wall for the pressure chamber and configured to change capacity of the pressure chamber.

10 Claims, 7 Drawing Sheets

INK-JET PRINT HEAD, INK-JET PRINTER USING THE SAME AND METHOD FOR MANUFACTURING INK-JET PRINT HEAD

CROSS-REFERENCE TO RELATED APPLICATIONS

This application is based upon and claims the benefit of priority from Japanese Patent Application No. 2010-184202, filed on Aug. 19, 2010; the entire contents of which are incorporated herein by reference.

FIELD

Embodiments described herein relate generally to an ink-jet print head incorporated in an ink-jet printer and a method for manufacturing the ink-jet print head.

BACKGROUND

Known ink-jet print heads include a piezoelectric member, a plurality of grooves aligned in the piezoelectric member, an electrode formed on the internal surface of each of the grooves, a plurality of walls by which the grooves are separated, and a cover bonded to the walls so as to link them.

FIG. 9 is a partially cutaway perspective view of such an ink-jet print head 100. As shown in FIG. 9, the ink-jet print head 100 includes a base member 110, a frame 120 laid upon the base member 110, and an orifice plate 130 laid over this frame 120.

Actuators 111 are formed in two lines on the base member 110. Each actuator 111 includes driving elements (projections) 112 and pressure chambers 113 disposed alternately. The pressure chambers 113 are arranged so as to correspond to nozzles 131 (described later). Each driving element 112 is formed by joining together two plates made of piezoelectric zirconate titanate (PZT). These two plates are bonded such that their polarization directions are opposite to each other. The plates form a projecting shape so as to be adjacent to the pressure chambers 113 on both sides.

The base member 110 includes ink discharge apertures 114 and ink supply apertures 115 along the actuators 111. The ink discharge apertures 114 and the ink supply apertures 115 communicate with a manifold (not shown) located below the base member 110 in FIG. 9. Thereby, ink is circulated and supplied to the pressure chambers 113. That is, the pressure chambers 113 are filled with ink.

The nozzles 131 are formed in two lines in the orifice plate 130. Each nozzle 131 ejects droplets of ink through the action of the corresponding actuator 111.

FIG. 10 is an enlarged plan view of a main portion of the ink-jet print head 100. A wire 116 for transmitting a signal from a head driving integrated circuit (IC) (not shown) is connected to each driving element 112.

In such an ink-jet print head 100, a driving pulse voltage is applied to each driving element 112 from the head driving IC via the print wire 116. Consequently, a corresponding pair of left and right driving elements 112 causes shear mode deformation to curve away from each other. Subsequently, these driving elements 112 return to their initial positions, thereby applying pressure to liquid in the corresponding pressure chambers 113. Consequently, a droplet of liquid is shot forth.

However, the foregoing ink-jet print head suffers from a problem as described below. Specifically, since the ink supply apertures 114 and ink discharge apertures 115 need to be formed in the base plate 110, the base plate 110 should not be constructed from a brittle material. Taking account of external forces applied to the base material 110 during manufacture limits the choice of materials. Another problem is that the formation of a large number of apertures in the base member 110 increases manufacturing costs.

Additionally, as shown in FIG. 10, since the print wires 116 avoid the ink supply apertures 114 and the ink discharge apertures 115, the wires are disposed at narrow pitches near these ink supply apertures 114 and ink discharge apertures 115, complicating the process of manufacture.

Incidentally, if the print wires 116 are disposed at narrow pitches, carbon or other substances contained in the ink may be deposited and accumulate on the print wires 116, leading to a short circuit with the respective adjacent print wires 116.

Therefore, it is necessary to improve reliability by circulating and supplying ink to the pressure chamber without formation of ink supply and discharge apertures in the base member, thereby reducing the manufacturing costs and preventing short circuiting of the print wires.

DETAILED DESCRIPTION

In general, according to one embodiment, an ink-jet print head according to the embodiment comprises: a support member including a flat portion with an ink supply aperture and an ink discharge aperture formed therein so as to circulate and supply ink, the flat portion including a recess; a base plate fitted in the recess of the support member; a nozzle plate laid over the base plate at a predetermined distance from the base plate and including a plurality of nozzles formed therein in a fixed direction; and an actuator disposed between the base plate and the nozzle plate and including a pressure chamber and a piezoelectric member, the pressure chamber being provided for each corresponding nozzle, and the piezoelectric member being provided to form a wall for the pressure chamber and configured to change capacity of the pressure chamber.

First Embodiment

Figure 1A:
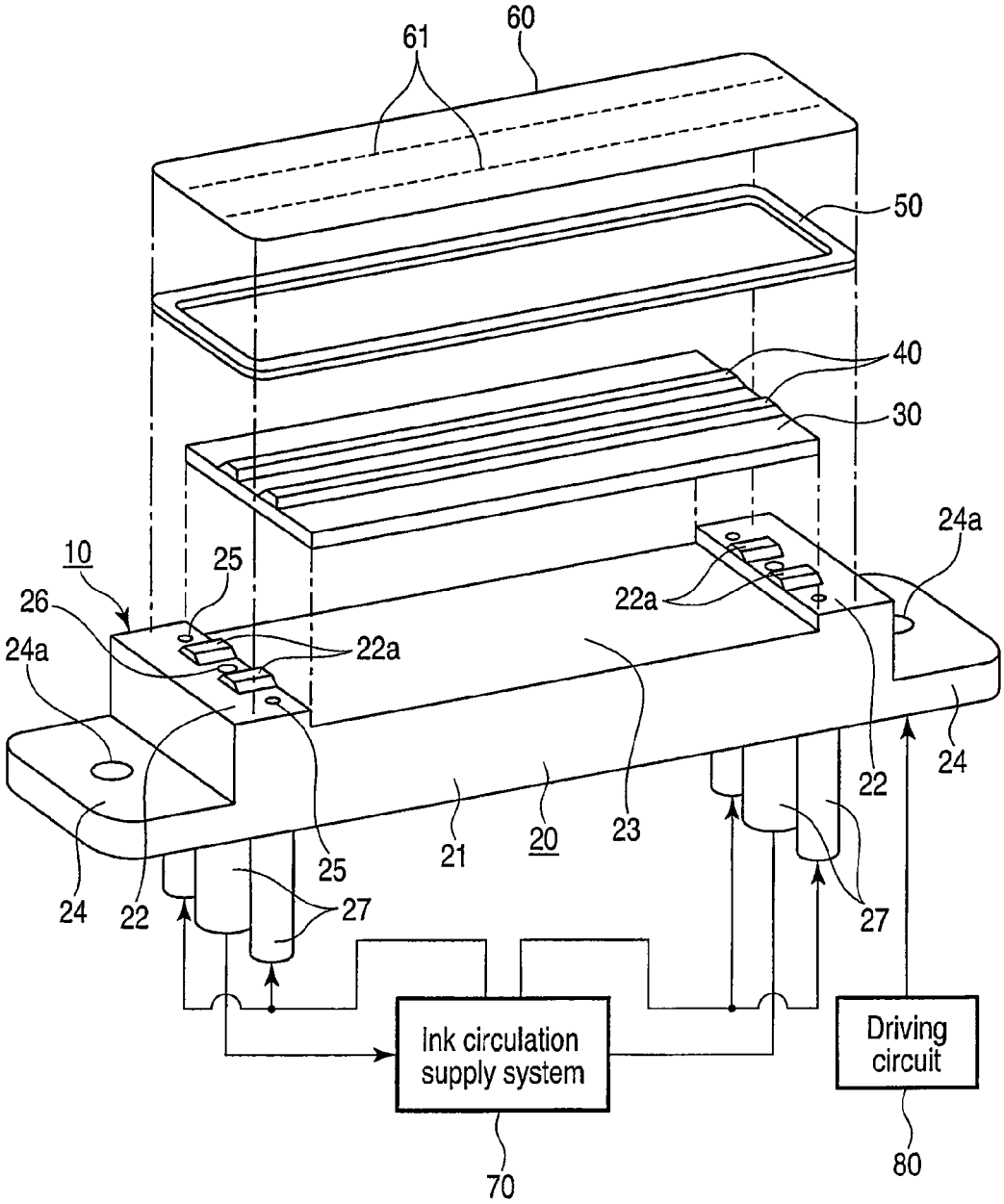
FIG. 1A is a perspective view of an ink-jet print head according to a first embodiment.
Figure 1B:
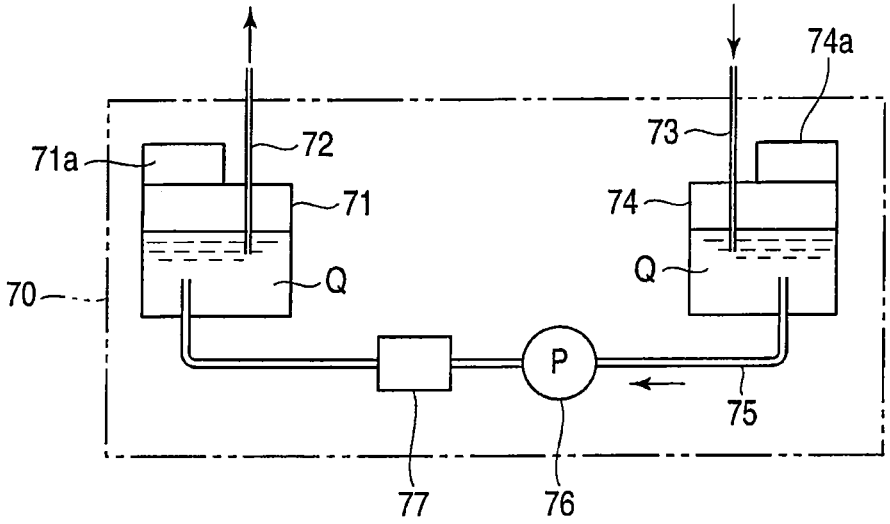
FIG. 1B is an explanatory view showing an ink circulation supply system.
Figure 2:
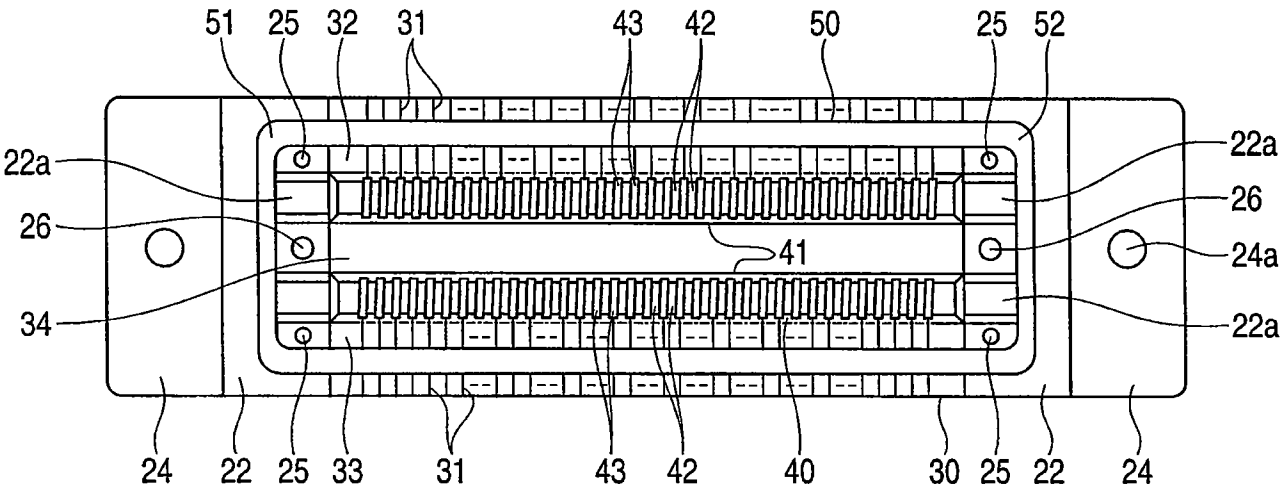
FIG. 2 is a plan view of the ink-jet print head from which a nozzle plate has been detached.

FIG. 1A is a perspective view of an ink-jet print head 10 according to a first embodiment, FIG. 1B is an explanatory view showing an ink circulation supply system, and FIG. 2 is a plan view showing the ink-jet print head 10 from which a nozzle plate 60 has been detached.

As shown in FIG. 1A, the ink-jet print head 10 includes: a manifold (support member) 20 in which channels are formed for circulating and supplying ink; a base member (base plate) 30 laid over the manifold 20 using an adhesive or the like; actuators 40 laid in two lines over the base member 30; a frame member 50 disposed in an area surrounding the actuators 40; and a nozzle plate 60 disposed at a predetermined distance from the base member 30. In FIG. 1A, reference number 70 represents an ink circulation supply system, and reference number 80 represents a driving circuit. The ink-jet print head 10, the ink circulation supply system 70, the driving circuit 80, and the like constitute an ink-jet printer.

The manifold 20 includes: a main body 21 in the form of a rectangular parallelepiped; a flat portion 22 formed on one side of the main body 21; a recess 23 formed in the middle of the flat portion 22; and brackets 24 formed at both ends of the main body 21. Formed in the brackets 24 are screw holes 24*a* for attaching the ink-jet print head 10 to a printer main body (not shown).

The flat portion 22 includes ink discharge apertures 25 and ink supply apertures 26 for circulating and supplying ink. The ink discharge apertures 25 and the ink supply apertures 26 are connected to the ink circulation supply system 70 via pipes 27 connected to the manifold 20.

The flat portion 22 includes partitions 22*a* separating the ink discharge apertures 25 from the ink supply apertures 26. The partitions 22*a* are located along lines extended from the corresponding actuators 40, and one end of each partition 22*a* is in close contact with the corresponding end of each actuator 40.

The base member 30 has a plate form and no aperture is formed therein. Wires 31 are formed on the base member 30.

Each actuator 40 includes: a piezoelectric portion 41 formed by bonding two PZT plates so that their polarization directions are opposite to each other; driving elements 42 disposed along the piezoelectric portion 41; and pressure chambers 43 disposed between the driving elements 42. That is, the driving elements 42 and the pressure chambers 43 are disposed alternately. Each driving element 41 is formed in a projecting shape so as to abut on the lower surface of the nozzle plate 60. Further, the wire 31 is connected to each driving element 42. The actuator 40 applies a voltage to each driving element 42 from the driving circuit 80, thereby deforming the corresponding pressure chamber 43 and changing the capacity of the chamber 43, thus ejecting ink from the pressure chamber 43 through a corresponding nozzle 61 (described later).

As shown in FIG. 2, both ends 51 and 52 of the frame member 50 project from the flat portion 22 of the manifold 20 and surround the ink discharge apertures 25 and the ink supply apertures 26. The function of the frame member 50 is to form an ink channel in the base member 30.

The nozzle plate 60 is made of polyimide and includes the aforementioned nozzles 61 disposed in a fixed direction and in positions corresponding to the pressure chambers 43.

A first ink tank 71 is provided in the ink circulation supply system 70. The first ink tank 71 not only contains the ink Q for supply to the pressure chamber 43 in the ink-jet print head 10, but also additionally comprises a first atmospheric pressure source 71*a*.

The ink Q within the first ink tank 71 is guided into the manifold 20 of the ink-jet print head 10 by a first ink channel 72. The guided ink Q runs through the pressure chamber 43 of the ink-jet print head 10 and flows out from the manifold 20 into a second ink channel 73. The ink Q flowing out into the second ink channel 73 is guided to a second ink tank 74.

The second ink tank 74 receives the ink Q flowing out from the pressure chamber 43 of the ink-jet print head 10, and additionally comprises a second atmospheric pressure source 74*a*.

A third ink channel 75 is provided between the second ink tank 74 and the first ink tank 71. In a pump 76 and a filter 77 are provided in the third ink channel 75, and the ink Q is fed to the first ink tank 71 by operation of the second pump 76. The filter 77 removes foreign matter mixed into the ink Q running through the third ink channel 75.

The first ink tank 71, the first ink channel 72, the ink-jet print head 10, the second ink channel 73, the second ink tank 74, the third ink channel 75, the second pump 76, and the filter 77 form a circulating path for the ink Q.

Figure 3:
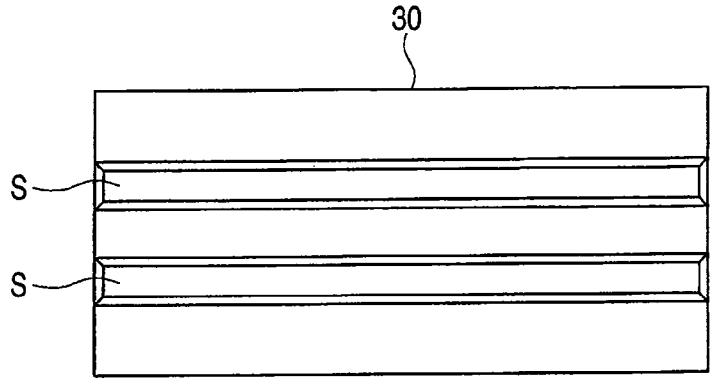
FIG. 3 is a plan view illustrating one step in the manufacturing process for the ink-jet print head.
Figure 4:
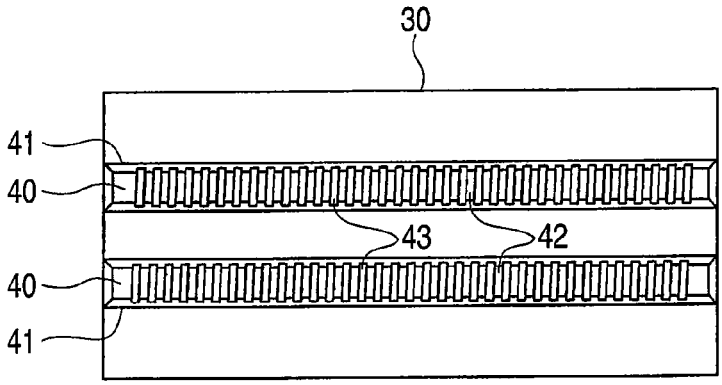
FIG. 4 is a plan view illustrating one step in the manufacturing process for the ink-jet print head.
Figure 5:
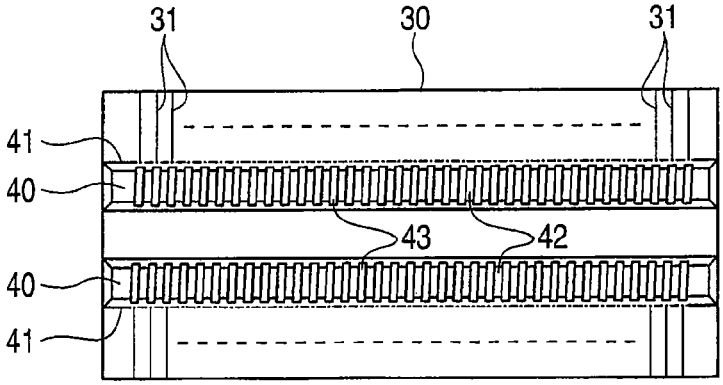
FIG. 5 is a plan view illustrating one step in the manufacturing process for the ink-jet print head.

The ink-jet print head 10 with the foregoing configuration is manufactured in the manner described below. Specifically, as shown in FIG. 3, piezoelectric material S, which is the material for the actuator 40, is bonded to the base member 30. Then, as shown in FIG. 4, using a diamond cutter or the like, a plurality of grooves are formed, thereby defining the pressure chambers 43. Subsequently, as shown in FIG. 5, the wires 31 are formed by means of plating or the like, and thus the actuator 40 is formed.

Subsequently, as shown in FIG. 2, the frame member 50 is placed on the base member 30 in such an area that the frame member 50 surrounds the actuators 40, both ends 51 of the frame member 50 project from the flat portion 22 of the manifold 20 and surround the ink discharge apertures 25 and the ink supply apertures 26.

Then, the nozzle plate 60 is joined onto the frame member 50. At this time, the pressure chambers 43 and the corresponding nozzles 61 are made to face each other. Next, the base member 30 is fitted in the recess 23 formed in the manifold 20.

A predetermined gap is left between the base member 30 and the nozzle plate 60. The gap is divided by the actuators 40 into three spaces, i.e., outer channels 32 and 33 and an inner channel 34.

Figure 6:
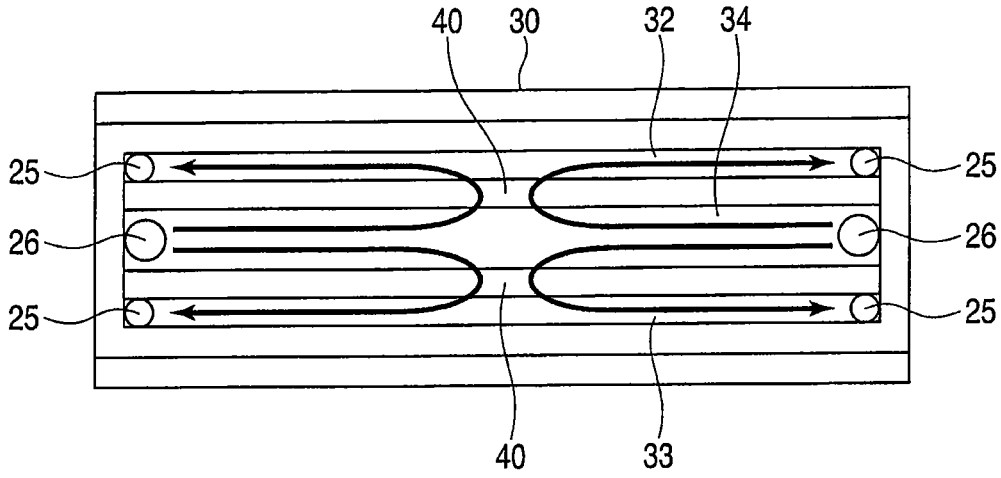
FIG. 6 is an explanatory view showing an example of the direction of flow of ink in the ink-jet print head.

The ink-jet print head 10 with the foregoing configuration ejects ink in the manner described below. Specifically, ink is supplied from the ink circulation supply system 70 via the pipes 27. Then, the ink thus supplied is further supplied to the inner channel 34 via the ink supply apertures 26. The ink supplied to the inner channel 34 flows into the outer channels 32 and 33 through the pressure chambers 43. The ink that has flowed into the outer channels 32 and 33 is discharged from the ink discharge apertures 25 and is returned into the ink circulation supply system 70 via the pipes 27. FIG. 6 schematically shows such flow of the ink. Since ink is continuously supplied in such a manner, the pressure chambers 43 are filled with ink.

Then, pulse voltages are applied to the driving elements 42 from the driving circuit 80 via the wires 31. As a result, the driving elements 42 are deformed, decreasing the capacity of the pressure chambers 43. Consequently, ink is discharged from the nozzles 61.

Since the flat portion 22 is provided with the partitions 22*a*, ink is prevented from flowing into the inner channel 34 from the outer channels 32 and 33 without passing through the pressure chambers 43.

The ink-jet print head 10 with the foregoing configuration eliminates the need to form apertures, such as the ink discharge apertures 25 and the ink supply apertures 26, in the base member 30, thus increasing the degree of freedom in the choice of material for the base member 30 and obviating the need for the formation of a large number of apertures, thus reducing manufacturing costs.

The present embodiment eliminates the need for disposition of the wires 31 to avoid the apertures, and hence prevents occurrence of areas where the wires 31 are disposed at narrow pitches. Accordingly, the manufacturing process is simplified and manufacturing costs are reduced.

Figure 7:
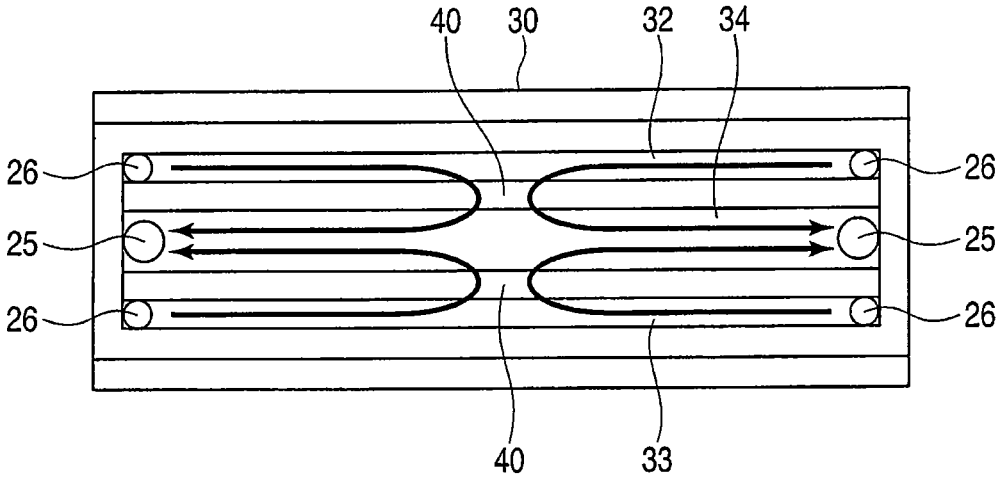
FIG. 7 is an explanatory view showing another example of the direction of flow of ink in the ink-jet print head.

FIG. 7 is an explanatory view showing another example of the direction of flow of ink in the ink-jet print head 10. That is, even reversal of the relative positions of the ink discharge apertures 25 and the ink supply apertures 26 will yield similar effects.

Second Embodiment

Figure 8:
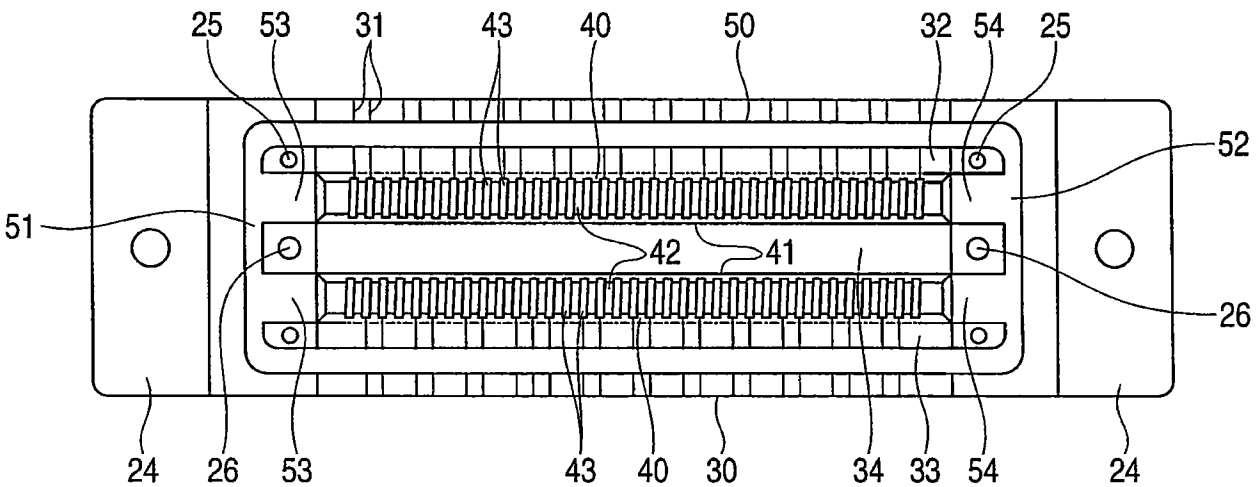
FIG. 8 is a plan view of an ink-jet print head according to a second embodiment, from which a nozzle plate has been detached.
Figure 9:
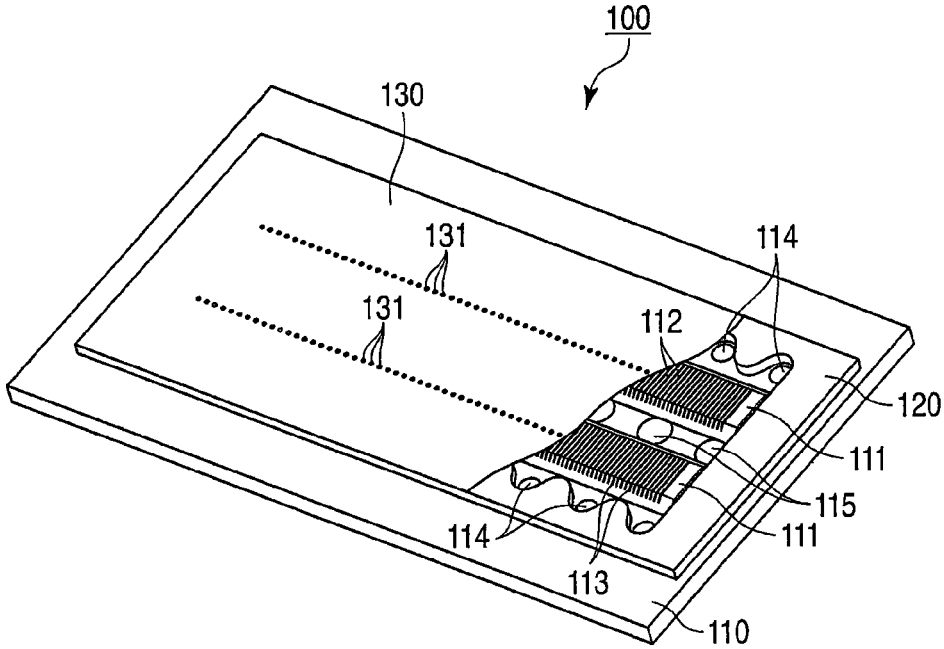
FIG. 9 is a partially cutaway perspective view of an example of an ink-jet print head.
Figure 10:
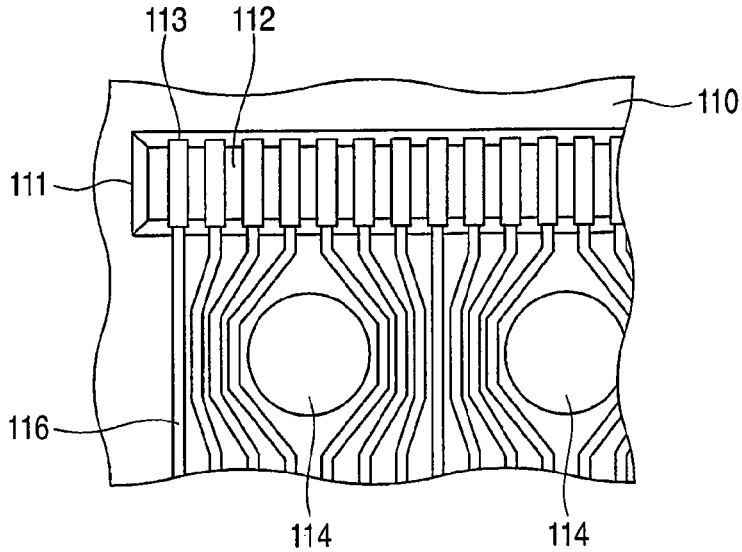
FIG. 10 is a plan view of a main portion of the ink-jet print head.

FIG. 8 is a plan view of an ink-jet print head 10A according to a second embodiment, from which a nozzle plate 60 has been detached. In FIG. 8, components with functions similar to those in FIG. 1A are denoted with the same signs and detailed explanation thereof is omitted.

In the ink-jet print head 10A, a frame member 50A is provided instead of the frame member 50, and a flat portion 22 of a manifold 20 includes no partition 22*a*.

The frame member 50A includes ends 51 and 52 that include projecting portions 53 and projecting portions 54, respectively, extending inward therefrom. The projections 53 and 54 are formed in the same positions as the partitions 22*a* described above, and their functions are identical to those of the partitions 22*a*. Accordingly, even the ink-jet print head 10A yields the same effects as the ink-jet print head 10.

While certain embodiments of the invention have been described, these embodiments have been presented by way of example only, and are not intended to limit the scope of the inventions. Indeed, the novel embodiments described herein may be embodied in a variety of forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink-jet print head comprising:

a support member including a flat portion with an ink supply aperture and an ink discharge aperture formed therein and a recess portion;

a base plate fitted in the recess portion;

a nozzle plate placed over the base plate with a predetermined spacing from the base plate and including a plurality of nozzles formed therein, the nozzles facing the base plate and not facing the ink discharge aperture;

an actuator disposed between the base plate and the nozzle plate and including a pressure chamber provided for each corresponding nozzle, and piezoelectric members that form walls for the pressure chambers which are deformable; and a frame member disposed between the base plate and the nozzle plate, both ends of the frame member having portions that project toward the flat portion of the support member, the ink supply aperture and the ink discharge aperture being arranged inside an area surrounded by the projecting portions of the frame member, and the nozzle plate being joined to the frame member and having a lower surface that abuts the piezoelectric members.

2. The ink-jet print head according to claim 1, wherein the support member includes a partition disposed on the flat portion that separates the ink supply aperture from the ink discharge aperture.

3. The ink-jet print head according to claim 1, wherein the frame member includes a partition disposed on the flat portion that separates the ink supply aperture from the ink discharge aperture.

4. The ink-jet print head according to claim 1, wherein the base plate includes wires that are each connected to a corresponding piezoelectric member.

5. The ink-jet print head according to claim 1, wherein ink is supplied to the pressure chambers through the ink supply aperture and discharged from the pressure chambers through the ink discharge aperture.

6. The ink-jet print head according to claim 1, wherein the nozzles are aligned along a longitudinal axis of the nozzle plate.

7. The ink-jet print head according to claim 1, wherein the walls of each pressure chamber are configured to deform to cause a change in capacity of the pressure chamber.

8. An ink-jet print head comprising:

a support member including a flat portion, an ink supply aperture and an ink discharge aperture, the flat portion including a recess, the ink supply aperture and the ink discharge aperture being formed at a portion other than the recess and configured to circulate and supply ink, a base plate fitted in the recess portion;

a nozzle plate placed over the base plate with a predetermined spacing from the base plate and including a plurality of nozzles formed therein, the nozzles facing the base plate and not facing the ink discharge aperture; and an actuator disposed between the base plate and the nozzle plate and including a pressure chamber provided for each corresponding nozzle, and piezoelectric members that form walls for the pressure chamber which are deformable.

9. The ink-jet print head according to claim 8, further comprising a frame member disposed between the base plate and the nozzle plate, both ends of the frame member projecting toward the flat portion of the support member and being disposed in an area which surrounds the ink supply aperture and the ink discharge aperture.

10. An ink-jet print head comprising:

a support member including a flat portion and a recess portion;

a base plate fitted within the recess portion;

a nozzle plate placed over the base plate with a predetermined spacing from the base plate and including a plurality of nozzles formed therein;

an actuator disposed between the base plate and the nozzle plate and including a pressure chamber provided for each corresponding nozzle, and piezoelectric members that form walls for the pressure chambers which are deformable; and a frame member disposed between the base plate and the nozzle plate, both ends of the frame member having portions that project toward the flat portion of the support member, the flat portion having first and second apertures between which ink is supplied to the pressure chambers flow, the first and second apertures being arranged inside an area surrounded by the projecting portions of the frame member and outside the recess portion, and the nozzle plate being joined to the frame member and having a lower surface that abuts the piezoelectric members.

* * * * *